US009414170B2

(12) United States Patent
Özden et al.

(10) Patent No.: US 9,414,170 B2
(45) Date of Patent: Aug. 9, 2016

(54) HEARING AID HAVING AN ADAPTIVE ANTENNA MATCHING MECHANISM AND A METHOD FOR ADAPTIVELY MATCHING A HEARING AID ANTENNA

(71) Applicant: GN ReSound A/S, Ballerup OT (DK)

(72) Inventors: Sinasi Özden, Rodovre (DK); Birol Akdeniz, Brøndby Strand (DK)

(73) Assignee: GN RESOUND A/S, Ballerup (DK)

( * ) Notice: Subject to any disclaimer, the term of this patent is extended or adjusted under 35 U.S.C. 154(b) by 0 days.

(21) Appl. No.: 13/797,795

(22) Filed: Mar. 12, 2013

(65) Prior Publication Data

US 2014/0185813 A1 Jul. 3, 2014

(30) Foreign Application Priority Data

Dec. 28, 2012 (DK) ..... 2012 70830
Dec. 28, 2012 (EP) ..... 12199666

(51) Int. Cl.
*H04R 25/00* (2006.01)

(52) U.S. Cl.
CPC ..... *H04R 25/552* (2013.01); *H04R 25/554* (2013.01); *H04R 2225/51* (2013.01)

(58) Field of Classification Search
CPC ..... H04R 25/552; H04R 2225/51
USPC ..... 381/23.1, 315
See application file for complete search history.

(56) References Cited

U.S. PATENT DOCUMENTS

| | | | | |
|---|---|---|---|---|
| 2001/0046880 | A1* | 11/2001 | Hosonuma | 455/550 |
| 2002/0085728 | A1* | 7/2002 | Shennib et al. | 381/328 |
| 2004/0037442 | A1* | 2/2004 | Nielsen et al. | 381/315 |
| 2005/0244024 | A1* | 11/2005 | Fischer et al. | 381/331 |
| 2008/0024375 | A1 | 1/2008 | Martin et al. | |
| 2008/0226107 | A1 | 9/2008 | Boguslavskij et al. | |

(Continued)

FOREIGN PATENT DOCUMENTS

| | | | |
|---|---|---|---|
| EP | 1708306 | A1 | 10/2006 |
| EP | 2 552 017 | A1 | 1/2013 |
| JP | 2006-180448 | A | 7/2006 |

(Continued)

OTHER PUBLICATIONS

First Technical Examination and Search Report dated Aug. 9, 2013 for related Danish Patent Application No. PA 2012 70830, 4 pages.

(Continued)

*Primary Examiner* — Ahmad F Matar
*Assistant Examiner* — Katherine Faley
(74) *Attorney, Agent, or Firm* — Vista IP Law Group, LLP

(57) ABSTRACT

A method of matching a hearing aid antenna in a binaural hearing aid in accordance with a detected signal strength of a received communication signal, the binaural hearing aid having a first hearing aid to be positioned at one ear of a user and a second hearing aid to be positioned at another ear of the user, the method includes: receiving a communication signal by a wireless communication unit in the first hearing aid; detecting a signal strength of the received communications signal; and controlling a matching mechanism positioned in the first hearing aid and/or the second hearing aid to improve antenna reception and/or antenna transmission according to the detected signal strength.

19 Claims, 6 Drawing Sheets

(56) References Cited

U.S. PATENT DOCUMENTS

| | | | |
|---|---|---|---|
| 2009/0196444 | A1 | 8/2009 | Solum |
| 2010/0321269 | A1 | 12/2010 | Ishibana et al. |

FOREIGN PATENT DOCUMENTS

| | | | |
|---|---|---|---|
| WO | 98/48526 | A2 | 10/1998 |
| WO | WO 99/43185 | A1 | 8/1999 |
| WO | WO 02/28143 | A2 | 4/2002 |
| WO | WO 2006/074655 | A1 | 7/2006 |
| WO | WO 2009/122403 | A1 | 10/2009 |
| WO | 2009/156879 | A1 | 12/2009 |
| WO | 2012/084026 | A1 | 6/2012 |

OTHER PUBLICATIONS

Extended European Search Report dated May 6, 2013 for EP Patent Application No. 12199666.4, 6 pages.

Notice of Reasons for Rejection (non-final Office Action) dated Jun. 24, 2014 for related Japanese Patent Application No. 2013-258222, 7 pages.

* cited by examiner

HEARING AID HAVING AN ADAPTIVE ANTENNA MATCHING MECHANISM AND A METHOD FOR ADAPTIVELY MATCHING A HEARING AID ANTENNA

RELATED APPLICATION DATA

This application claims priority to and the benefit of Danish Patent Application No. PA 2012 70830, filed on Dec. 28, 2012, pending, and European Patent Application No. 12199666.4, filed on Dec. 28, 2012, pending. The disclosures of both of the above applications are expressly incorporated by reference in their entireties herein.

FIELD

The present application relates to hearing aids, especially binaural hearing aids, configured for wireless communication and having wireless communication properties, and more specifically to binaural hearing aids capable of adaptively matching an antenna to the environment by detecting a signal strength of a received and/or transmitted signal and adjusting antenna properties accordingly.

BACKGROUND

Hearing aids are very small and delicate devices and comprise many electronic and metallic components contained in a housing small enough to fit in the ear canal of a human or behind the outer ear. The many electronic and metallic components in combination with the small size of the hearing aid housing impose high design constraints on radio frequency antennas to be used in hearing aids with wireless communication capabilities.

Conventionally, antennas in hearing aids have been used for receiving radio broadcasts or commands from a remote control. Typically, such antennas are designed to fit in the hearing aid housing without special concern with relation to the efficiency of the antenna.

It is known in the art to provide matching circuitry for antennas, and also for antennas used in hearing aids. The matching circuitry may match the impedance of the antenna to the applicable radio or transceiver used and may optimise the effective length of the antenna to the frequency of the radio or transceiver. The matching is typically performed upon initial fitting of the hearing aid, or as disclosed in US2009/0196444, upon replacement of antenna conductors which may vary in for example length from one to another.

SUMMARY

It is an objective of the present invention to provide a hearing aid, such as a binaural hearing aid, providing an adaptive matching for a hearing aid antenna, such as providing an adaptive matching in response to detection of a received signal strength.

According to a first aspect of the present invention, a binaural hearing aid comprising a first hearing aid and a second hearing aid is provided, each hearing aid comprising a microphone for reception of sound and conversion of the received sound into a corresponding first audio signal, a signal processor for processing the first audio signal into a second audio signal compensating a hearing loss of a user of the hearing aid, a wireless communications unit connected to the signal processor for wireless communication and being interconnected with an antenna for emission and/or reception of an electromagnetic field. The first hearing aid and/or the second hearing aid have/has an adjustable antenna matching mechanism configured to receive information on a detected signal strength and configured to adaptively adjust the matching mechanism to optimize antenna reception/emission according to the detected signal strength.

The first hearing aid and/or the second hearing aid may have a detector connected to the wireless communications unit, and the detector may be configured to detect a signal strength of a communications signal received or transmitted through the wireless communications unit.

Alternatively, a hearing aid accessory may comprise the detector and information on the detected signal strength may be provided to the adjustable antenna matching mechanism for example via the wireless communications unit. Furthermore, a hearing aid fitting system may comprise the detector and information on the detected signal strength may be provided to the adjustable antenna matching mechanism for example via the wireless communications unit.

In another aspect of the present invention, a hearing aid is provided, the hearing aid having a microphone for reception of sound and conversion of the received sound into a corresponding first audio signal, a signal processor for processing the first audio signal into a second audio signal compensating a hearing loss of a user of the hearing aid, a wireless communications unit connected to the signal processor for wireless data communication and being interconnected with an antenna for emission and/or reception of an electromagnetic field. The hearing aid further comprises an antenna matching mechanism configured to receive information on a detected signal strength from a detector and adaptively control the antenna matching mechanism to optimize antenna reception according to the detected signal strength of the received signal. The hearing aid may further comprise the detector, and the detector may be connected to the wireless communications unit. The detector is configured to detect a signal strength of a signal received or transmitted through the wireless communications unit.

According to a further aspect of the present invention, a method of matching a hearing aid antenna in a binaural hearing aid in accordance with a detected signal strength of a received communications signal is provided. The binaural hearing aid having a first hearing aid to be positioned at one ear of a user and a second hearing aid to be positioned at another ear of the user, the method comprising receiving a communications signal by a wireless communications unit in the first hearing aid, detecting a signal strength of the received communications signal, and adaptively adjusting a matching mechanism positioned in the first hearing aid and/or the second hearing aid to obtain optimized antenna reception and/or transmission according to the detected signal strength, such as in response to the detected signal strength.

According to a still further aspect of the present invention, a method of adaptively matching a hearing aid antenna to optimize a received communications signal strength is provided. The method comprises detecting the signal strength of a received communications signal, adaptively adjust a hearing aid antenna matching mechanism to optimize received communications signal strength.

The communications signal may be transmitted from the second hearing aid to the first hearing aid for detection, thus the communications signal received in one hearing aid of a binaural hearing aid may be received from another of the hearing aids of the binaural hearing aid.

In one or more embodiments the communications signal received through the wireless communications unit in one hearing aid is a signal transmitted from the other of the first and second hearing aids in a binaural hearing aid. Thus, the signal strength of a signal received from the second hearing aid may be detected.

It is envisaged that the adaptive adjustment may be performed during a fitting procedure fitting the hearing aid to a user, or the adaptive adjustment may be performed during use of the hearing aid.

The received signal strength may be an indication of the power level of the communications signal received by the antenna. The signal strength may be detected or measured according to any known methods, including for example measuring using a detector comprising received signal strength indicator (RSSI) circuitry, received channel power indicator (RCPI) circuitry, etc. Furthermore, also the signal noise ratio (SNR) may be measured.

The signal strength of the received signal may be detected or measured in the hearing aid, such as by a detector provided in the hearing aid, such as in the first hearing aid of a binaural hearing aid having a first and a second hearing aid. In some embodiments the detector may form part of the wireless communications unit, such as part of a radio.

A controller for controlling the matching circuit may be provided, such as provided in the wireless communications unit.

An adjustable antenna matching mechanism provided in the hearing aid, or in the first hearing aid and/or the second hearing aid of a binaural hearing aid, is configured to receive information on the detected signal strength and configured to adaptively adjust the matching mechanism to optimize antenna reception/emission according to the detected signal strength.

Alternatively, the signal strength of a signal transmitted from the hearing aid to e.g. an accessory device, or to a hearing aid fitting system, may be detected in the accessory device or in the hearing aid fitting system, respectively, and information on the transmitted signal strength may be provided to an adjustable antenna matching mechanism provided in the hearing aid, the adjustable antenna matching mechanism being configured to adaptively adjust the matching mechanism to optimize antenna reception/emission according to the detected signal strength.

The antenna matching mechanism may be configured to adjust an impedance of the antenna matching mechanism to optimize antenna reception.

The antenna matching mechanism may be a closed adaptive matching loop using a variable inductance in the matching circuitry. It is envisaged that the impedance may be adjusted according to a predetermined list of values, or that the impedance may be iteratively adjusted until an optimized antenna reception/transmission is obtained.

The adjustable antenna matching mechanism may be configured to iteratively adjust the antenna matching mechanism until an end-adjustment criteria is reached, and the adjustable antenna matching mechanism may be configured to adjust the antenna matching mechanism upon receiving a detected signal strength being less than a predetermined threshold. The adjustable antenna matching mechanism may be configured to iteratively adjust the antenna matching mechanism until an end-adjustment criteria being the reception of a detected signal strength above the predetermined threshold is reached.

It is an advantage of the present invention that it is possible to control the field distribution of the antenna by adaptively adjusting the antenna matching mechanism taking into account different antenna structures, different antenna environments, etc.

It is envisaged that the signal strength may be detected remotely, that is for example either in an accessory device, in a hearing aid fitting system, or in one of the first and second hearing aids of a binaural hearing aid, etc. Subsequently, either information on the detected signal strength, such as a received signal strength indicator may be transmitted to the hearing aid, such as to the other of the first and second hearing aids of a binaural hearing aid or adjustment parameters may be provided to the hearing aid, such as to the other of the first and second hearing aid of a binaural hearing aid. The adjustment parameters may comprise impedance values, such as capacitor values, conductance values, etc.

In one or more embodiments, the detector is configured to detect the signal strength upon triggering to adaptively adjust the matching mechanism to optimize antenna reception. The detector may be triggered by hearing aid adjustments, such as program selections, environmental changes, etc.

The hearing aid adjustments may be performed automatically, without direct interaction from a user.

The wireless communications unit is configured for wireless data communication, and in this respect interconnected with the antenna for emission and reception of an electromagnetic field. The wireless communications unit may comprise a transmitter, a receiver, a transmitter-receiver pair, such as a transceiver, a radio unit, etc. The wireless communications unit may be configured for communication using any protocol as known for a person skilled in the art, including Bluetooth, WLAN standards, manufacture specific protocols, such as tailored proximity antenna protocols, such as proprietary protocols, such as low-power wireless communication protocols, etc.

The wireless communications unit interconnected with the antenna may be configured for operation in the ISM frequency band. The wireless communications unit interconnected with the antenna may be configured for operation at a frequency of at least 100 MHz, such as at a frequency of at least 800 MHz, such as at at least 1 GHz, such as at a frequency between 1.5 GHz and 3 GHz, such as at a frequency of 2.4 GHz, such as at substantially 2.4 GHz.

The wireless communications unit may be configured for communication with external devices, such as hearing aid accessories, such as remote controls, telephones, such as mobile telephones, televisions, television boxes, television streamer boxes, spouse microphones, hearing aid fitting systems, etc.

The wireless communications unit may also be configured for communication with another hearing aid in a binaural hearing aid, so that data may be exchanged between the hearing aid positioned at the right ear of a user and the hearing aid positioned at the left ear of the user. Such binaural communication may be used for example for binaural beam forming, for binaural noise reduction, etc.

The hearing aid may further comprise an attachment member, such as an attachment member transmitting the second audio signal from the hearing aid housing to the ear of a user when the hearing aid is worn in its intended operational position and wherein at least a part of the antenna extends via the attachment member.

The antenna, or at least the part of the antenna extending via the attachment member, may have a length being correlated with a length of the attachment member. The antenna, or at least the part of the antenna extending via the attachment member, may have substantially a same length as the attachment member. Alternatively, the antenna, or at least the part of the antenna extending via the attachment member, may have substantially a same length irrespective of the length of the attachment member.

The attachment member may be an electrical connection to a receiver in the ear of a user, a sound tube, such as a thin tube configured for acoustic wave propagation, or an ear hook, such as an ear hook for holding the hearing aid in a desired position around the ear of a user.

The attachment member may be any attachment member configured to be attached to the hearing aid, such as to a hearing aid housing. The attachment member may be a holding member for holding the hearing aid in place during use, the attachment member may be configured to transmit the second audio signal from the hearing aid housing to the ear of a user, etc.

The length of the attachment member may be determined by the size of a user's ear to allow for a smooth fitting, and may for example be selected during fitting of the hearing aid. The length of an attachment member varies depending on the type of attachment member provided. For some attachment members, e.g. for attachment members for sound transmission, the length of the attachment members may typically range from about 50 mm to about 70 mm, and the attachment members are typically available in a number of predetermined lengths. As the attachment members are exposed to the environment, including the user's head, the material may degrade over time, and typically need to be exchanged at regular intervals. As the length may vary from one attachment member to another attachment member, that is, either the length of the attachment member and/or the length of the part of the antenna extending via the attachment member may vary, an adaptively adjustable matching mechanism ensures that the field distribution of the antenna is substantially unchanged.

It is an advantage of being able to maintain a constant field distribution of the antenna especially to maintain a constant ear-to-ear performance of a binaural hearing aid.

Especially for binaural hearing aids, the performance of the ear-to-ear link, that is the wireless communication between a first hearing aid and a second hearing aid in a binaural hearing aid, is crucial for optimum operation, such as for synchronization between the first and second hearing aids to e.g. achieve sound localization, and for e.g. noise reduction.

To obtain the best possible ear-to-ear link, there are basically two methods, either to increase the power in the ear-to-ear link or increase the size of the antenna. It is not desirable to increase the power in the ear-to-ear link due to the conflicting need to increase battery lifetime, and the size of the antenna is typically limited by the hearing aid dimensions.

In one or more embodiments, the hearing aids have an attachment element and the antenna extend at least partly into the attachment element. The attachment element may have a variable length as discussed above depending on e.g. the size of a user's head. To optimize the performance of the ear-to-ear link, the antenna may be as long as possible, and thus for a user having a larger size, i.e. longer, attachment element also the size of the antenna may be increased. As the field distribution on the antenna is an important factor in ear-to-ear communication, there is a need to control the field distribution. The field distribution may be controlled in that the length of the antenna element extending at least partly into the attachment element is kept constant irrespective of the length of the attachment element. However, in order to take advantage of the longer attachment elements, the antenna element may extend further into a longer attachment element. The length of the antenna element extending into the attachment element may for example correspond to, such as correspond substantially to, the length of the attachment element.

To control the field distribution on antenna elements having different lengths, a matching mechanism may be provided, and the field distribution may be controlled by adjusting the matching mechanism according to the length of the attachment member or antenna used. To enable adaptive matching of the matching mechanism, the hearing aid may comprise a detector configured to detect a signal strength of a communications signal received through the wireless communications unit and adjust the matching mechanism in response hereto, e.g. by providing a closed adaptive matching loop. Thereby, the field distribution on the antenna may be controlled and the different lengths of the attachment members may be accounted for. Hereby, the binaural efficiency may be increased when the length of the attachment member used is increased.

A binaural hearing aid comprising a first hearing aid and a second hearing aid, each of the first and second hearing aids includes: a microphone for reception of sound and conversion of the received sound into a corresponding first audio signal; a signal processor for processing the first audio signal into a second audio signal compensating a hearing loss of a user of the hearing aid; and a wireless communication unit connected to the signal processor for wireless communication and being coupled with an antenna for emission and/or reception of an electromagnetic field; wherein the first hearing aid has a detector connected to the wireless communication unit of the first hearing aid, the detector being configured to detect a signal strength of a communication signal received through the wireless communications unit of the first hearing aid; and wherein at least one of the first hearing aid and the second hearing aid has an adjustable antenna matching mechanism configured to receive information on the detected signal strength, and adjust the antenna matching mechanism to improve antenna reception or antenna emission of the antenna of the at least one of the first hearing aid and the second hearing aid according to the information on the detected signal strength of the received communication signal.

Optionally, the communication signal received through the wireless communications unit of the first hearing aid may be a signal transmitted from the second hearing aid.

Optionally, the first hearing aid may further comprise a receive signal strength indicator (RSSI) circuit for measuring the signal strength of the communication signal.

Optionally, the first hearing aid may further comprise an attachment member configured for transmitting the second audio signal to an ear of the user when the first hearing aid is worn in its intended operational position, and wherein at least a part of the antenna of the first hearing aid extends in the attachment member.

Optionally, the antenna of the first hearing aid may have a length that correlates with a length of the attachment member.

Optionally, the attachment member may comprise an electrical connection to a receiver in the ear of the user, a sound tube, or an ear hook.

Optionally, the signal strength of the received communication signal may be associated with a hearing aid fitting procedure.

Optionally, the detector of the first hearing aid may be configured to detect the signal strength upon triggering of the detector to adaptively adjust the antenna matching mechanism to optimize antenna reception.

Optionally, the detector may be configured to be triggered by hearing aid adjustments.

Optionally, an impedance of the antenna matching mechanism may be adjustable to improve the antenna reception.

Optionally, the adjustable antenna matching mechanism may be configured to iteratively adjust the antenna matching mechanism until an end-adjustment criteria is reached.

Optionally, the adjustable antenna matching mechanism may be configured to adjust the antenna matching mechanism in response to the detected signal strength being less than a predetermined threshold.

Optionally, the adjustable antenna matching mechanism may be configured to iteratively adjust the antenna matching mechanism until an end-adjustment criteria is reached, and wherein the end-adjustment criteria comprises a reception of a detected signal strength that is above the predetermined threshold.

A method of matching a hearing aid antenna in a binaural hearing aid in accordance with a detected signal strength of a received communication signal, the binaural hearing aid having a first hearing aid to be positioned at one ear of a user and a second hearing aid to be positioned at another ear of the user, the method includes: receiving a communication signal by a wireless communication unit in the first hearing aid; detecting a signal strength of the received communications signal; and controlling a matching mechanism positioned in the first hearing aid and/or the second hearing aid to improve antenna reception and/or antenna transmission according to the detected signal strength.

Optionally, the communication signal may be transmitted from the second hearing aid to the first hearing aid.

Other and further aspects and features will be evident from reading the following detailed description of the embodiments.

It is envisaged that features and characteristics of one aspect and/or embodiment are applicable to another aspect and/or embodiment, mutatis mutandis.

The present embodiments will now be described more fully hereinafter with reference to the accompanying drawings, in which exemplary embodiments are shown. The claimed invention may, however, be embodied in different forms and should not be construed as limited to the embodiments set forth herein. Like reference numerals refer to like elements throughout. Like elements will, thus, not be described in detail with respect to the description of each figure.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting in the scope of the claims.

DETAILED DESCRIPTION

Figure 1:
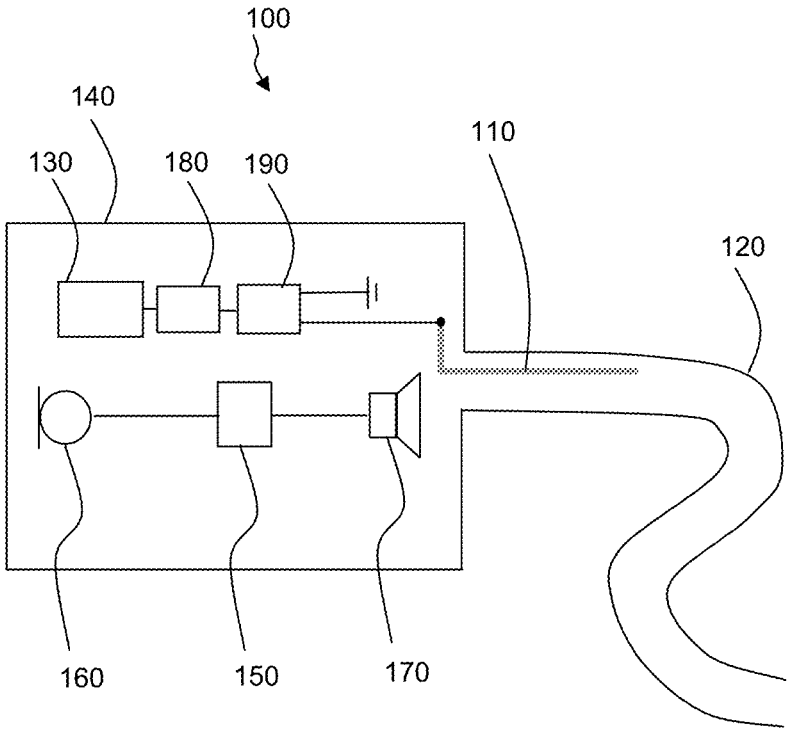
FIG. 1 shows schematically a hearing aid.

Various embodiments are described hereinafter with reference to the figures. It should be noted that the figures are not necessarily drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

In FIG. 1, a hearing aid 100 is shown schematically. The hearing aid has a microphone 160 for reception of sound and conversion of the received sound into a corresponding first audio signal, a signal processor 150 for processing the first audio signal into a second audio signal compensating a hearing loss of a user of the hearing aid, a speaker 170 for providing sound to a user, a wireless communications unit 130 connected to the signal processor 150 for wireless data communication and being interconnected with an antenna 110 for emission and/or reception of an electromagnetic field. The wireless communications unit may be a radio, such as a radio, such as a multi protocol radio, such as a radio supporting Bluetooth as well as proprietary wireless protocols. The hearing aid further has a detector 180 connected to the wireless communications unit 130. The detector is configured to detect a signal strength of a signal received through the wireless communications unit 130. An antenna matching mechanism 190 is configured to receive the detected signal strength from the detector 180 and adaptively control the matching mechanism 190 to optimize antenna reception according to the detected signal strength of the received signal. The detected signal strength may be provided to the antenna matching mechanism as a control signal. The hearing aid may have an attachment element 120 coupled to a housing 140, and the antenna 110 may extend into the attachment element 120.

In some embodiment, the antenna matching mechanism may comprise, or consist of, a variable capacitor. The variable capacitor may form part of a matching circuitry for the antenna, such as a matching circuitry configured to match the antenna impedance to the radio, typically at 50 Ω.

Figure 2:
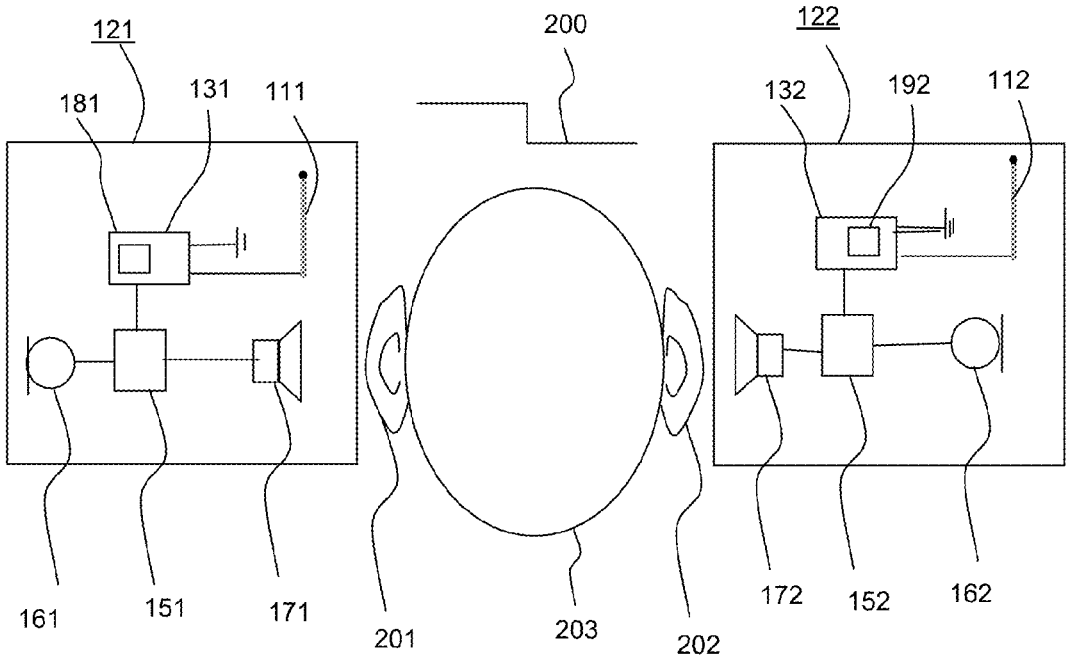
FIG. 2 shows schematically a binaural hearing aid having a detector in one hearing aid of the binaural hearing aid and an adaptively adjustable antenna matching mechanism in another of the hearing aids of the binaural hearing aid.

FIG. 2 shows a binaural hearing aid, each of the first and second hearing aids 121, 122 has a microphone 161, 162, a signal processor 151, 152, speaker 171, 172, a wireless communications unit 131, 132 connected to the signal processor 151, 152 for wireless data communication and being interconnected with antenna 111, 112 for emission and/or reception of an electromagnetic field.

The first and second hearing aids 121, 122 are configured to communicate with each other via wireless link 200 established between wireless communications units 131, 132 via antennas 111, 112. The first hearing aid 121 further has a detector 181 connected to the wireless communications unit 130. The detector 181 may be an RSSI detector and is in the present example provided in the wireless communications unit 131. The detector is configured to detect a signal strength of a signal received through the wireless communications unit 131. The signal is in this embodiment received from the second hearing aid 122 via the wireless link 200. The antenna matching mechanism 192 is thereby adaptively controlled to optimize antenna transmission according to the detected signal strength of the signal as received in the first hearing aid 121. Thus, information of the received signal strength is communicated from the detector 181 to the antenna matching mechanism 192, such as to an antenna matching controller configured to control the matching parameters for the antenna matching mechanism. The matching parameters may comprise inductance and capacitance of a matching circuitry in the antenna matching mechanism.

Even though speakers 170, 171, 172 are exemplary shown in the figures, it is envisaged that the hearing aid also may be a receiver in the ear type hearing aid, wherein the second signal is provided via an electrical connector in attachment member 120 (not shown in FIG. 2) to the ear 201, 202. When the receiver is provided in the hearing aid, such as in a behind the ear type hearing aid, the sound is typically transmitted to the ear 201, 202 via an attachment member comprising at least a sound tube.

Figure 3A:
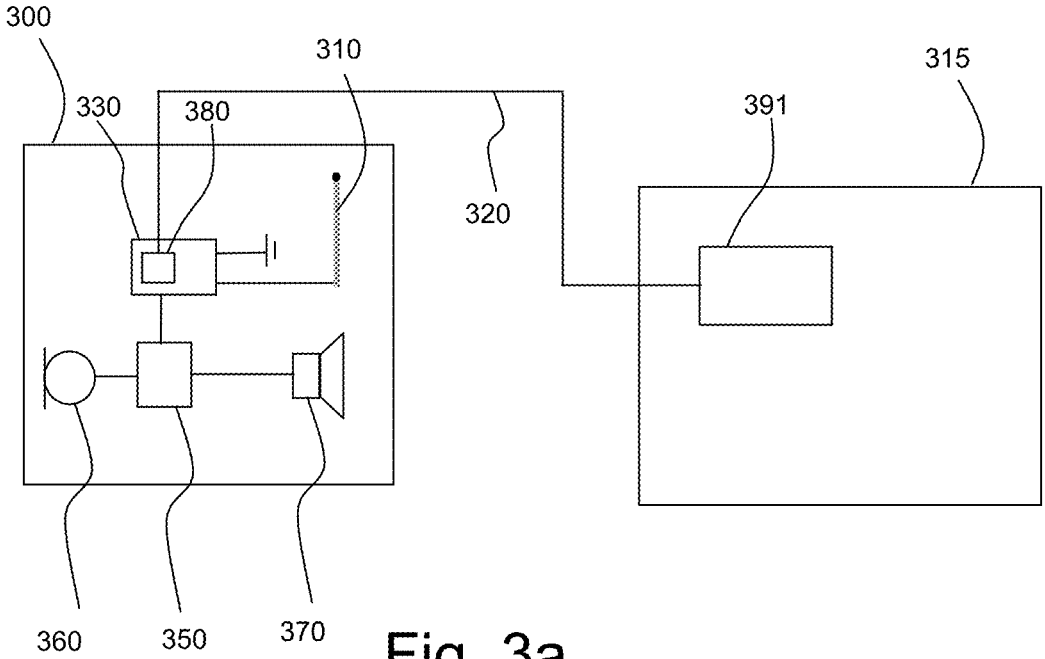
FIG. 3*a* shows a hearing aid communicating with a hearing aid fitting system, wherein the hearing aid fitting system comprises a detector.

In FIG. 3*a*, a hearing aid 300 is shown schematically, and it is seen that the hearing aid 300 has an adjustable antenna matching mechanism 380 configured to receive information on a detected signal strength and being configured to adaptively adjust the matching mechanism 380 to optimize antenna reception/emission according to the detected signal strength. The detector 391 is in the present example provided in a hearing aid fitting apparatus 315, and information 320 of the signal strength is provided to the hearing aid 300 and thus, the matching mechanism is adjusted during fitting of the hearing aid. The fitting apparatus 315 and the hearing aid may communicate wirelessly and/or via a wired connection 320. A signal processor 350, a microphone 360, and a speaker 370 (like those described with reference to FIG. 2) in the hearing aid 300 are also shown. Also, as shown in FIG. 3*a*, the matching mechanism 380 may optionally be a part of a detector 330 that is connected to an antenna 310.

Figure 3B:
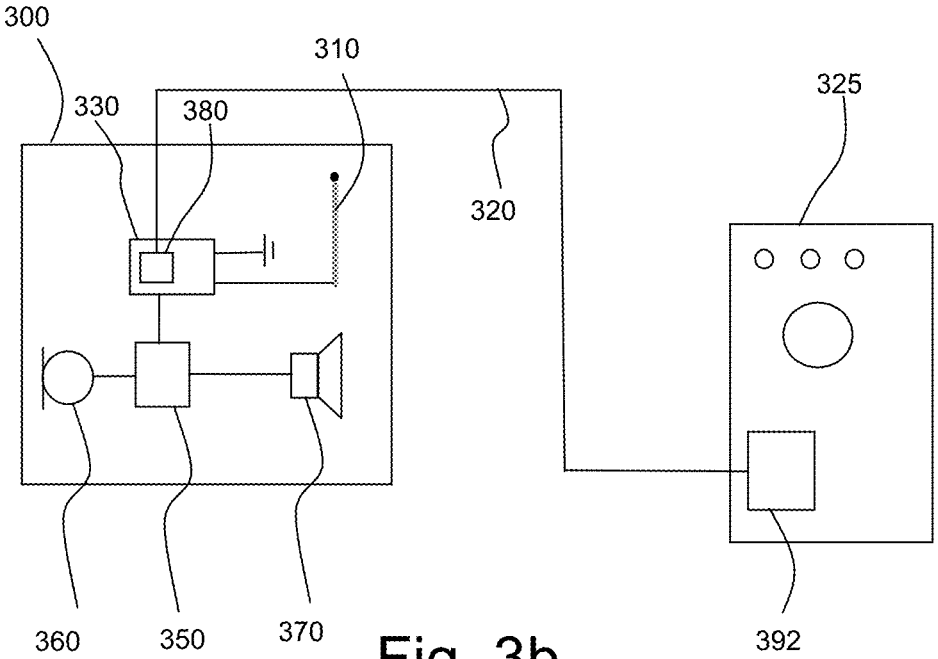
FIG. 3*b* shows a hearing aid communicating with a hearing aid accessory, wherein the hearing aid accessory comprises a detector.
Figure 4:
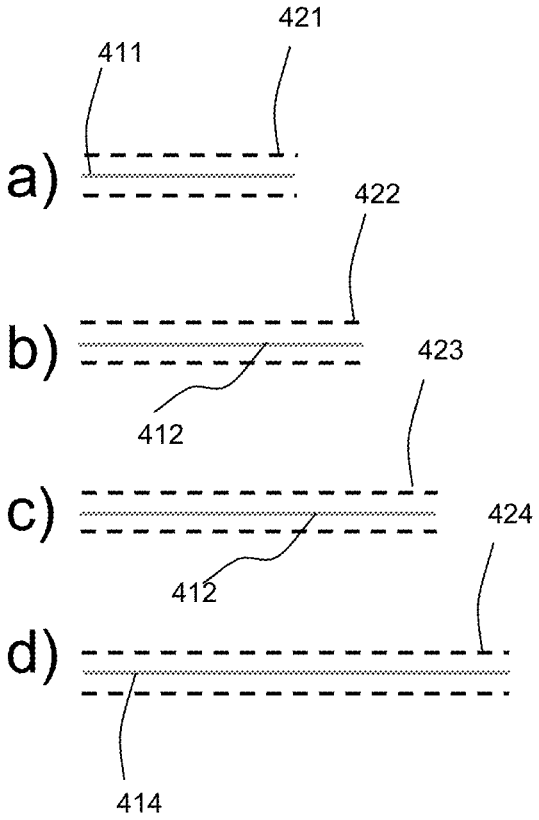
FIGS. 4*a-d* show schematically various attachment member lengths having different antenna lengths.

FIG. 3*b* shows hearing aid 300 connected to a hearing aid remote control 325 and the hearing aid remote control 325 may comprise the detector 392. The hearing aid matching mechanism may be adjusted via the remote control 325.

It is envisaged that any other hearing aid accessory may comprise a wireless communications unit and a detector to enable feedback on the information of the signal strength to the hearing aid. Typically, the hearing aid accessory and the hearing aid communicates via a hearing aid protocol, such as a proprietary protocol, using a wired or a wireless connection.

FIGS. 4*a-d* show variable lengths of antenna elements 411, 412, 413, 414 extending in attachment members 421, 422, 423, 424 of different lengths.

The length of the attachment member is typically determined by the size of a user's head and/or ear to allow for a smooth fitting, and may for example be selected during fitting of the hearing aid. The length of an attachment member varies depending on the type of attachment member provided. For example, the length of attachment members for sound transmission typically range from about 50 mm to about 70 mm, and the attachment members may be available in a number of predetermined lengths. As the attachment members are exposed to the environment, including the user's head, the material may degrade over time, and typically need to be exchanged at regular intervals. As the length may vary from one attachment member to another attachment member, that is, either the length of the attachment member and/or the length of the part of the antenna extending via the attachment member, an adaptively adjustable matching mechanism ensures that the field distribution of the antenna is substantially unchanged.

It is envisaged that the antenna elements 411, 412, 413, 414 extending into the attachment member may have a length being correlated with the attachment member length, and thus correlated with the size of a user's ear. The length of the antenna elements 411, 412, 413, 414 may substantially be corresponding to the attachment member length, however, the length of the antenna element 411, 412, 413, 414 may also be shorter than the attachment member, such as 30% shorter, such as 20%, such as 10% shorter, such as 5% shorter than the attachment member.

Table 1 below shows exemplary lengths of the attachment members for an attachment member being a sound tube.

| Tube name | length (mm) |
|---|---|
| −1B | 52.1 |
| 0A | 57.9 |
| 0B | 55.0 |
| 1A | 60.0 |
| 1B | 57.9 |
| 2A | 67.0 |
| 2B | 64.0 |
| 3A | 72.0 |
| 3B | 69.0 |

Figure 5:
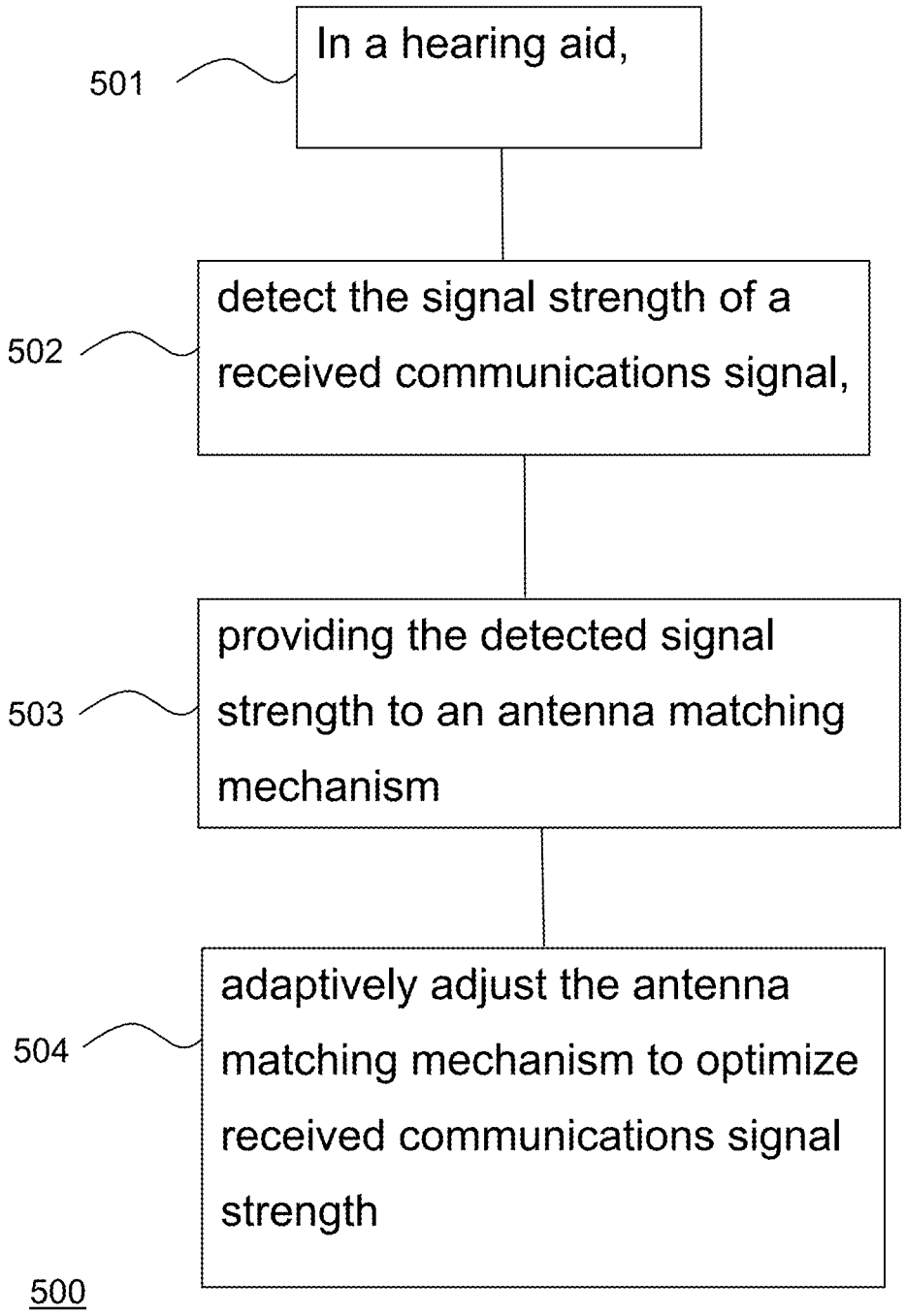
FIG. 5 shows a flow chart illustrating a method of adaptively adjusting an antenna matching mechanism in a hearing aid.

In FIG. 5, a flowchart illustrates a method 500 of adaptively matching a hearing aid antenna at a hearing aid 501 to optimize a received communications signal strength. The method comprises detecting the signal strength of a received communications signal (item 502), provide the detected signal strength, such as a control signal comprising information about the signal strength, to an antenna matching mechanism (item 503), and adaptively adjust a hearing aid antenna matching mechanism to optimize received communications signal strength (item 504).

Figure 6:
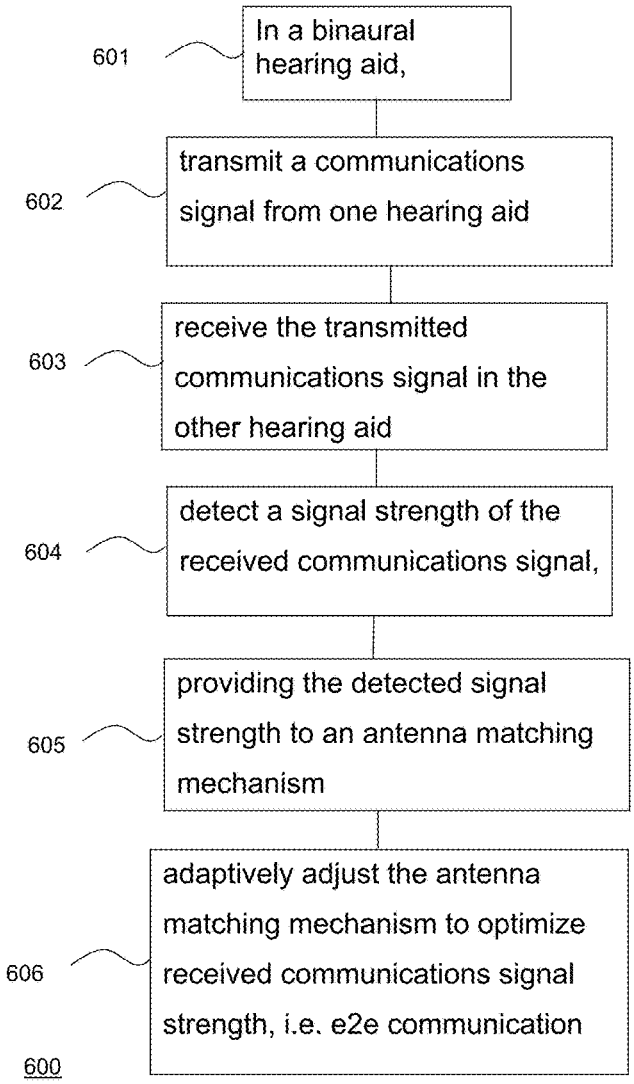
FIG. 6 shows a flow chart illustrating a method of adaptively adjusting an antenna matching mechanism in a binaural hearing aid.

In FIG. 6, a flowchart illustrates a method 600 of adaptively matching hearing aid antenna(s) in a binaural hearing aid 601. Especially for binaural hearing aids, the performance of the ear-to-ear link 200, that is the wireless communication between a first hearing aid 121 and a second hearing aid 122 in a binaural hearing aid, is crucial for optimum operation, such as for synchronization between the first and second hearing aids 121, 122 to e.g. achieve sound localization, and for e.g. noise reduction. The method includes transmitting a communication signal from one hearing aid (item 602), receiving the transmitted communication signal in another hearing aid (item 603), detecting a signal strength of the received communication signal (item 604), providing the detected signal strength to an antenna matching mechanism (item 605), and adaptively adjusting the antenna matching mechanism to optimize received communication signal strength (item 606).

The method 600 matches a hearing aid antenna 111,112 in a binaural hearing aid in accordance with a detected signal strength of a received communications signal. The method 600 comprises the steps of in a binaural hearing aid 601, transmitting a communications signal from one hearing aid in step 602, receiving the transmitted communications signal by a wireless communications unit in the other hearing aid in step 603, detecting a signal strength of the received communications signal in step 604, for example using a detector, such as an RSSI detector and provide the detected signal strength to an antenna matching mechanism to optimize received communications strength, such as in the ear-to-ear communication.

It is from the current description and the drawings envisaged that the detector and the matching mechanism may be provided in a same hearing aid, in a same binaural hearing aid, each in one or the other hearing aid in a binaural hearing aid, providing the antenna matching mechanism in a hearing aid and the detector in an accessory, such as in an accessory device, and any combination thereof. In embodiments wherein the detector and the antenna matching mechanism are provided separately, information about the detected signal strength may be fed back to the antenna matching mechanism either via a wireless communication connection or via a wired connection. The information about the detected signal strength may be provided in the form of a control signal, or the received signal strength may be provided as an indication of the power level being received by the antenna in connection with the detector, as an "above" or "below" threshold indication, and in any other way as known to a person skilled in the art.

Although particular embodiments have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A binaural hearing aid comprising a first hearing aid and a second hearing aid, each of the first and second hearing aids comprising:

a microphone for reception of sound and conversion of the received sound into a corresponding first audio signal;

a signal processor for processing the first audio signal into a second audio signal compensating a hearing loss of a user of the hearing aid; and a wireless communication unit connected to the signal processor for wireless communication and being coupled with an antenna for emission and/or reception of an electromagnetic field;

wherein the first hearing aid has a detector connected to the wireless communication unit of the first hearing aid, the detector being configured to detect a signal strength of a communication signal transmitted from the second hearing aid and received through the wireless communication unit of the first hearing aid;

wherein the first hearing aid has an adjustable antenna matching mechanism configured to improve antenna reception and/or antenna emission of the antenna of the first hearing aid in the binaural hearing aid based on the detected signal strength of the received communication signal transmitted from the second hearing aid in the binaural hearing aid; and wherein the antenna matching mechanism is configured to operate based on a matching parameter, the matching parameter comprising a capacitance value of a matching circuitry, and wherein the adjustable antenna matching mechanism is adjustable based on the detected signal strength being less than a threshold.

2. The binaural hearing aid according to claim 1, wherein the first hearing aid further comprises a receive signal strength indicator (RSSI) circuit for measuring the signal strength of the communication signal.

3. The binaural hearing aid according to claim 1, wherein the first hearing aid further comprises an attachment member configured for transmitting the second audio signal to an ear of the user when the first hearing aid is worn in its intended operational position, and wherein at least a part of the antenna of the first hearing aid extends in the attachment member.

4. The binaural hearing aid according to claim 3, wherein the antenna of the first hearing aid has a length that correlates with a length of the attachment member.

5. The binaural hearing aid according to claim 3, wherein the attachment member comprises an electrical connection to a receiver in the ear of the user, a sound tube, or an ear hook.

6. The binaural hearing aid according to claim 1, wherein the signal strength of the received communication signal is associated with a hearing aid fitting procedure.

7. The binaural hearing aid according to claim 1, wherein the detector of the first hearing aid is configured to detect the signal strength upon triggering of the detector to adaptively adjust the antenna matching mechanism to optimize antenna reception.

8. The binaural hearing aid according to claim 1, wherein the detector is configured to be triggered by hearing aid adjustments.

9. The binaural hearing aid according to claim 1, wherein an impedance of the antenna matching mechanism is adjustable to improve the antenna reception.

10. The binaural hearing aid according to claim 1, wherein the adjustable antenna matching mechanism is iteratively adjustable until an end-adjustment criteria is reached.

11. The binaural hearing aid according to claim 1, wherein the adjustable antenna matching mechanism is iteratively adjustable until an end-adjustment criteria is reached, and wherein the end-adjustment criteria comprises a reception of a detected signal strength that is above the threshold.

12. The binaural hearing aid according to claim 1, wherein a capacitance of the antenna matching mechanism is adjustable to improve the antenna reception.

13. The binaural hearing aid according to claim 1, wherein the first hearing aid has a custom-made hearing aid shell.

14. The binaural hearing aid according to claim 1, wherein the matching parameter is controllable.

15. A method of matching a hearing aid antenna in a binaural hearing aid, the binaural hearing aid having a first hearing aid to be positioned at one ear of a user and a second hearing aid to be positioned at another ear of the user, the method comprising:

receiving a communication signal by a wireless communication unit in the first hearing aid, the communication signal transmitted from the second hearing aid;

detecting a signal strength of the received communication signal; and controlling a first matching mechanism positioned in the first hearing aid to improve antenna reception and/or antenna transmission for the first hearing aid in the binaural hearing aid based on the detected signal strength of the communication signal transmitted from the second hearing aid in the binaural hearing aid, wherein the act of controlling the first matching mechanism comprises adjusting the first matching mechanism based on the detected signal strength being less than a threshold;

wherein the first matching mechanism is controlled based on a matching parameter, the matching parameter comprising a capacitance value of a matching circuitry.

16. The method according to claim 15, wherein the matching parameter is controllable.

17. A method of matching a hearing aid antenna in a binaural hearing aid, the binaural hearing aid having a first hearing aid to be positioned at one ear of a user and a second hearing aid to be positioned at another ear of the user, the method comprising:

receiving a communication signal by a wireless communication unit in the first hearing aid, the communication signal transmitted from the second hearing aid;

detecting a signal strength of the received communication signal;

controlling a first matching mechanism positioned in the first hearing aid to improve antenna reception and/or antenna transmission for the first hearing aid in the binaural hearing aid based on the detected signal strength of the communication signal transmitted from the second hearing aid in the binaural hearing aid, wherein the act of controlling the first matching mechanism comprises adjusting the first matching mechanism based on the detected signal strength being less than a threshold; and controlling a second matching mechanism positioned in the second hearing aid to improve antenna reception and/or antenna transmission for the second hearing aid.

18. A binaural hearing aid comprising a first hearing aid and a second hearing aid, each of the first and second hearing aids comprising:

a microphone for reception of sound and conversion of the received sound into a corresponding first audio signal;

a signal processor for processing the first audio signal into a second audio signal compensating a hearing loss of a user of the hearing aid; and a wireless communication unit connected to the signal processor for wireless communication and being coupled with an antenna for emission and/or reception of an electromagnetic field;

wherein the first hearing aid has a detector connected to the wireless communication unit of the first hearing aid, the detector being configured to detect a signal strength of a communication signal transmitted from the second hearing aid and received through the wireless communication unit of the first hearing aid;

wherein the first hearing aid has a first adjustable antenna matching mechanism configured to improve antenna reception and/or antenna emission of the antenna of the first hearing aid in the binaural hearing aid based on the detected signal strength of the received communication signal transmitted from the second hearing aid in the binaural hearing aid, and wherein the first adjustable antenna matching mechanism is adjustable based on the detected signal strength being less than a threshold; and wherein the second hearing aid has a second adjustable antenna matching mechanism configured to improve antenna reception and/or antenna emission of the antenna of the second hearing aid.

19. A binaural hearing aid comprising a first hearing aid and a second hearing aid, each of the first and second hearing aids comprising:

a microphone for reception of sound and conversion of the received sound into a corresponding first audio signal;

a signal processor for processing the first audio signal into a second audio signal compensating a hearing loss of a user of the hearing aid; and a wireless communication unit connected to the signal processor for wireless communication and being coupled with an antenna for emission and/or reception of an electromagnetic field;

wherein the first hearing aid has a detector connected to the wireless communication unit of the first hearing aid, the detector being configured to detect a signal strength of a communication signal transmitted from the second hearing aid and received through the wireless communication unit of the first hearing aid;

wherein the first hearing aid has an adjustable antenna matching mechanism configured to improve antenna reception and/or antenna emission of the antenna of the first hearing aid in the binaural hearing aid based on the detected signal strength of the received communication signal transmitted from the second hearing aid in the binaural hearing aid, and wherein the adjustable antenna matching mechanism is adjustable based on the detected signal strength being less than a threshold; and wherein the first hearing aid is an in-the-ear hearing aid having a housing, at least a part of the antenna of the first hearing aid extending in the housing.

* * * * *